US005806456A

United States Patent [19]

Peabody

[11] Patent Number: 5,806,456

[45] Date of Patent: Sep. 15, 1998

[54] VARIABLE ATTACT ANGLE MARINE SPADE ANCHORS

[76] Inventor: Andrew L. Peabody, P.O. Box 2120, Natches, Miss. 39121

[21] Appl. No.: 878,571

[22] Filed: Jun. 19, 1997

[51] Int. Cl.[6] ..... B63B 21/32

[52] U.S. Cl. ..... 114/301; 114/310

[58] Field of Search ..... 114/294, 300, 114/301, 310, 297

[56] References Cited

U.S. PATENT DOCUMENTS

| | | | |
|---|---|---|---|
| 4,173,938 | 11/1979 | Colin | 114/301 |
| 4,397,256 | 8/1983 | Bruce | 114/303 |
| 5,067,430 | 11/1991 | Ford | 114/294 |
| 5,133,277 | 7/1992 | Peabody | 114/294 |

FOREIGN PATENT DOCUMENTS

| | | | |
|---|---|---|---|
| 56-75287 | 6/1981 | Japan | 114/301 |
| 7606300 | 12/1976 | Netherlands | 114/301 |
| 2 035 242 | 6/1980 | United Kingdom | 114/301 |

*Primary Examiner*—Sherman Basinger
*Attorney, Agent, or Firm*—Carroll F. Palmer

[57] ABSTRACT

Plow type anchors that include a fluke and an arcuate shank having a long leg portion and a short leg portion that attaches the long leg portion to the fluke are improved by being provided with a plurality of hitch members spaced apart longitudinally along the long leg portion enabling an anchor line to be attached to the anchor at different positions along the arcuate shank to thereby provide a plurality of attack angles at which the anchor will enter and proceed into the mooring bed during an anchoring operation employing the anchor.

5 Claims, 3 Drawing Sheets

VARIABLE ATTACT ANGLE MARINE SPADE ANCHORS

BACKGROUND OF THE INVENTION

1. Field of the Invention

This application relates broadly to marine anchors. More particularly, it concerns marine anchors of the spade type in which the angle of attack of the fluke in burial of the anchor into a mooring bed may be varied to compensate for differences in holding qualities of mooring beds.

2. Description of the Prior Art

When a marine anchor is cast from a vessel onto a mooring bed, it must orient itself so that it will bury its fluke into the bed rather than slide over the bed's surface. Once penetration of that surface is attained, the anchor fluke should then assume a attack angle that will cause the anchor to bury rapidly into the bed. The most effective attack angle can vary with the nature of the composition of the mooring bed, e.g., a sand mooring bed as opposed to a mooring bed formed of muck.

In order to permit wider variation and control over the attack angle, it is known to provide arrangements in marine anchors that allow the relative angle between the shank of the anchor and the fluke to be changed. This has been accomplished by providing a plurality of bolt or pin positions for fixing the anchor shank relative to the fluke, e.g., see U.S. Pat. No. 4,397,256 and 5,133,277 for spade type anchors and U.S. Pat. No. 5,140,931 for kedge type anchors.

Rearranging nuts and bolts or pins on anchors as part of an anchoring operation present a variety of problems, e.g., loss of a bolt, nut or pin. The present invention provides new improvements in marine anchor design that eliminate these prior art problems while enabling the improved anchors to have variable attack angles for penetration of the anchors into mooring beds.

OBJECTS

A principal object of the invention is the provision of anchors of improved design that permit the user to choose one of a plurality of attack angles at which the anchor will tend to enter and proceed into the mooring bed during an anchoring operation.

Further objects include the provision of improved anchors that:

1. Have critically improved ability to penetrate and bury deep in mooring beds.
2. Can be quickly adjusted to select one of a plurality of attack angles for the fluke to enter a mooring bed to compensate for differences in holding qualities of mooring beds.
3. Dig continuously and deeply into a mooring bed when strain is placed thereon by the anchor line.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by providing spade type anchors, i.e. those that include a fluke and an arcuate shank having a long leg portion and a short leg portion that attaches the long leg portion to the fluke, with a plurality of hitch members fixed to and spaced apart longitudinally along the long leg portion enabling an anchor line to be attached to the anchor at different positions along the arcuate shank to thereby provide a plurality of attack angles at which the anchor will enter and proceed into the mooring bed during an anchoring operation employing the anchor.

In the marine anchors to which the invention pertains, the fluke component is in the form of a contoured plate defined by a fluke prow end, a fluke aft end, a pair of identical fluke starboard and fluke port halves, a fluke top surface and a fluke bottom surface, such plate having balanced starboard and port halves divided by a fluke longitudinal axis of symmetry.

Also, the shank component is of arcuate form having a shank longitudinal axis and comprises first and second leg portions. The first leg portion is elongated and is defined by a first prow end, a first aft end, an first upper side, a first lower side, a first starboard side and a first port side.

The second leg portion is shorter than the first leg portion and is defined by a second top end and a second bottom end, the second top end being joined to the first aft end and the bottom end being joined to the fluke aft end so that the shank longitudinal axis is aligned with the fluke longitudinal axis of symmetry.

A plurality of hitch members are fixed to and spaced apart along the elongated first leg enabling an anchor line to be attached to the anchor at different positions along the shank component to thereby provide a plurality of attack angles at which the anchor will tend to enter and proceed into the mooring bed during an anchoring operation employing the anchor.

In a first embodiment, one of the plurality of hitch members is a transverse bore in the first prow end of the shank component and the marine anchor comprises a lug that extends upward from the first upper side of the first leg. This lug has a plurality of transverse bores therethrough that function as additional hitch members that receive shackles to join an anchor line to the anchor.

In a second embodiment, the shank component is in the form of a longitudinally extending truss unit comprising a pair of flat longitudinal plate members and a multiplicity of cross stiffeners. In this anchor, one of the hitch members is a transverse bore in the prow end of the shank component and the remaining hitch members are rods spaced apart longitudinally along the truss unit welded between the plate members.

BRIEF DESCRIPTION OF THE DRAWINGS

A more complete understanding of the invention can be obtained by reference to the accompanying drawings in which generic parts of the illustrated matter are indicated by arrowhead lines associated with the designation numerals while specific parts are indicated with plain lines associated with the numerals and wherein.

DESCRIPTION OF THE PREFERRED EMBODIMENTS

Figure 1:
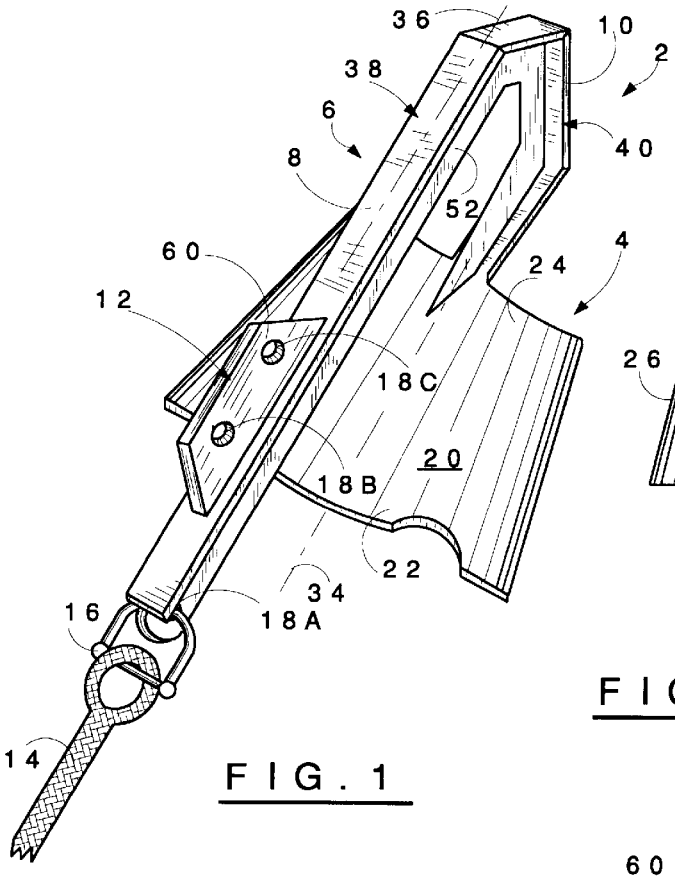
FIG. 1 is an isometric view of one embodiment of an improved spade type anchor of the invention.
Figure 2:
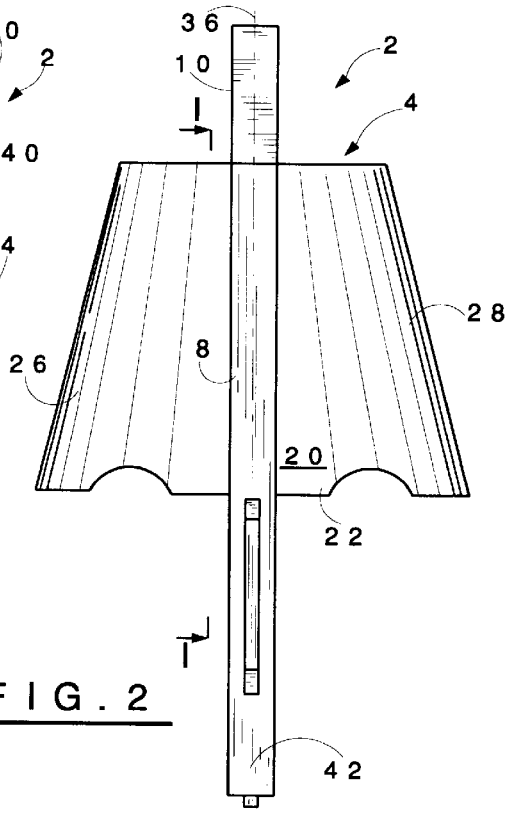
FIG. 2 is a plan view of the anchor of FIG. 1.
Figure 3:
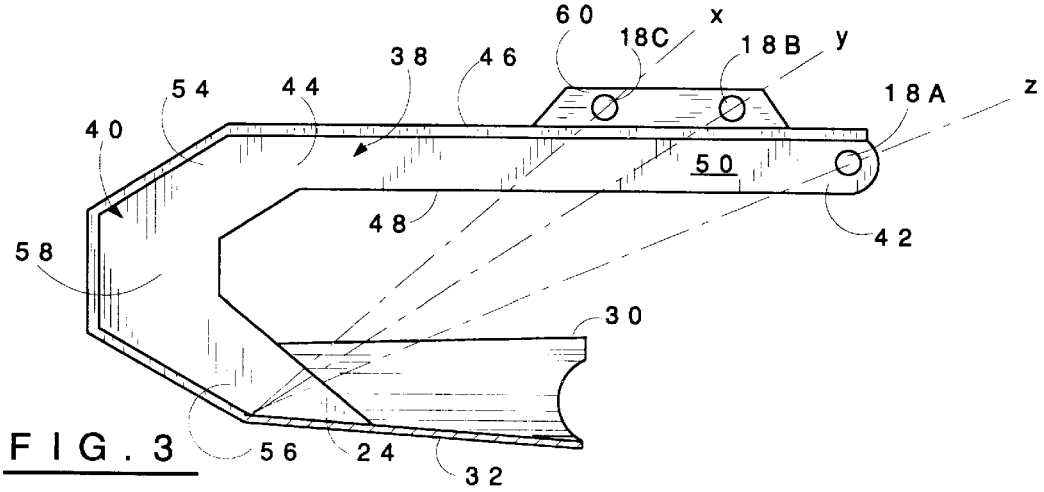
FIG. 3 is a sectional view taken on the line I—I of FIG. 2.

Referring initially in detail to FIGS. 1–3 of the drawings, a first embodiment of a spade type anchor 2 of the invention includes a fluke component 4 and an arcuate shank component 6 having a long leg portion 8 and a short leg portion 10 that attaches the long leg portion 8 to the fluke 4.

In accordance with the invention, the anchor 2 has a plurality of hitch members 12 fixed to and spaced apart longitudinally along the long leg portion 8 that enable an anchor line 14 to be attached via shackle 16 to the anchor 2 at different positions along the arcuate shank 6, i.e., at transverse bores 18A, 18B & 18C.

The fluke component 4 is in the form of a contoured trapezoidal plate 20 defined by a fluke prow end 22, a fluke aft end 24, fluke starboard halve 26, identical fluke port halve 28, a fluke top surface 30 and a fluke bottom surface 32 so that plate 20 is divided by a fluke longitudinal axis of symmetry 34.

The shank component 6 is of arcuate form having a shank longitudinal axis 36 and comprises a first leg portion 38 and second leg portion 40. The first leg portion 38 is elongated and is defined by a first prow end 42, a first aft end 44, an first upper side 46, a first lower side 48, a first starboard side 50 and a first port side 52. The second leg portion 40 is shorter than the first leg portion 38 and is defined by a second top end 54 and a second bottom end 56 joined by the integral middle portion 58. The top end 54 is joined to the first aft end 44 and the bottom end 56 is joined to the fluke aft end 24 so that the shank longitudinal axis 36 is aligned with the fluke longitudinal axis of symmetry 34.

The foremost hitch member 18A of anchor 2 is a transverse bore in the prow end 42 of the shank component 6.

The marine anchor 2 comprises a lug 60 that extends upward from the upper side 46 of the leg 38. This lug 60 has transverse bores therethrough that function as additional hitch members 18B & 18C that can receive shackles (not shown) to join 14 anchor line to the anchor 2 to thereby provide different attack angles at which the anchor 2 will enter and proceed into a mooring bed (not shown) during an anchoring operation employing anchor 2.

Figure 4:
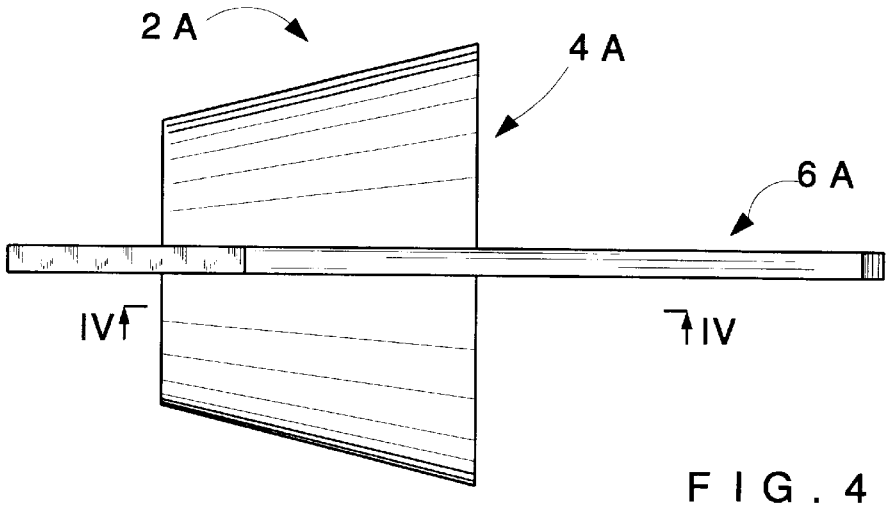
FIG. 4 is a plan view of another embodiment of an improved spade type anchor of the invention.
Figure 5:
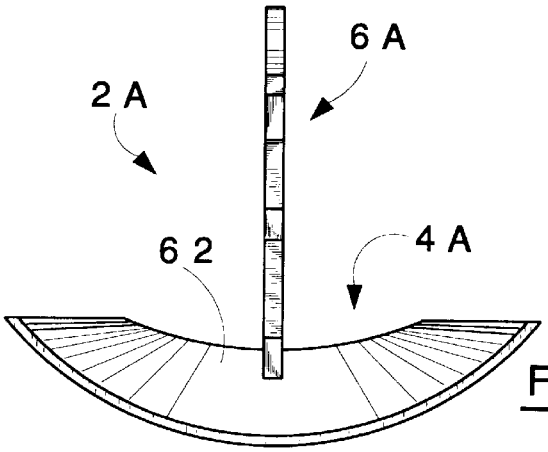
FIG. 5 is a prow end view of the anchor of FIG. 4.
Figure 6:
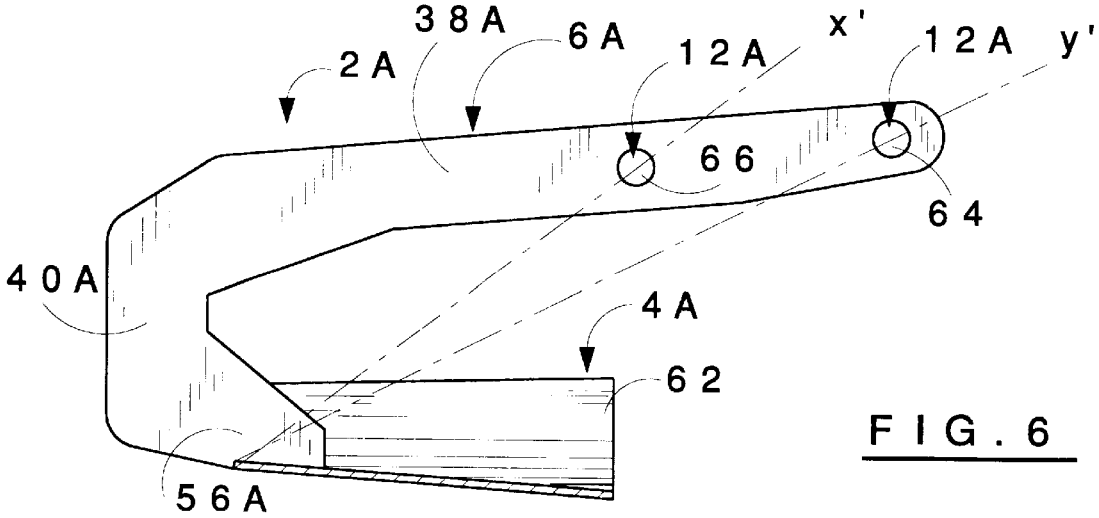
FIG. 6 is a sectional view taken on the line IV—IV of FIG. 4.

With reference to FIGS. 4–6, a second embodiment of anchor 2A in accordance with the invention comprises a fluke 4A in the form of a concave plate 62 and an arcuate shank 6A comprising a first leg portion 38A and second leg portion 40A which is fixed by its bottom end 56A to the plate 62.

In the anchor 2A, the plural hitch members 12A consist of transverse bores 64 & 66 in the shank leg portion 38A.

Figure 7:
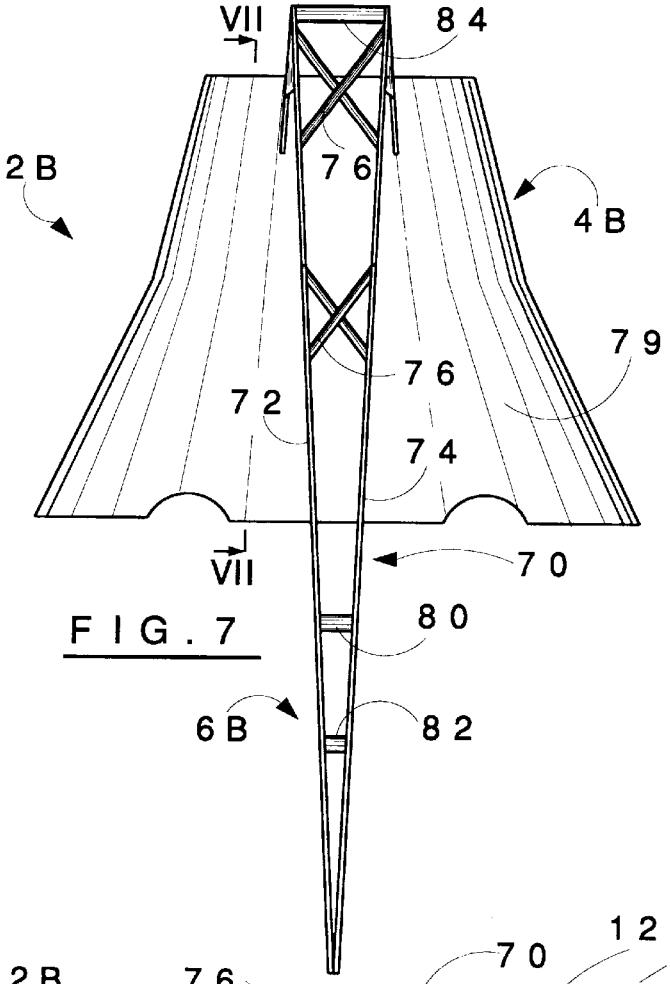
FIG. 7 is a plan view of yet another embodiment of an improved spade type anchor of the invention.
Figure 8:
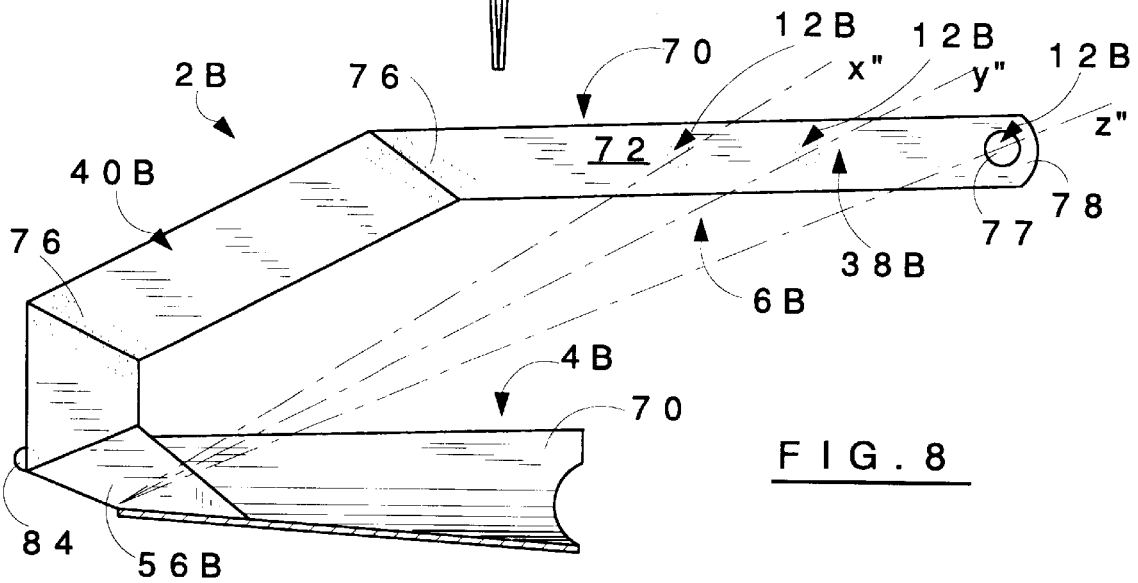
FIG. 8 is a sectional view taken on the line VII—VII of FIG. 7.

With reference to FIGS. 7 & 8, a third embodiment anchor 2B comprises a fluke 4B in the form of a concave plate 68 and an arcuate shank component 6B.

The shank component 6B is in the form of a longitudinally extending truss unit 70 comprising flat longitudinal starboard plate member 72 and port plate member 74 plus a multiplicity of cross stiffeners 76.

Although the shank 6B of anchor 2B differs from the shank 6 of anchor 2 by being made in the form of a truss unit 70 instead of from bar stock as in anchor 2, it still exists in a arcuate form comprising a first leg portion 38B and second leg portion 40B, the bottom section 56B of which is fixed to the plate 70.

In anchor 2B, one of the hitch members 12B is a transverse bore 76 in the prow end 78 of the shank component 6B and the remaining hitch members 12B are rods 80 & 82 spaced apart longitudinally along the truss unit 70 and welded between the plate members 72 & 74.

A transverse rod 84 in the bottom section 56B of shank 6B serves both as a cross stiffener for the truss unit 70 and as a purchase for the shackle (not shown) of a trip line (not shown).

As shown in FIG. 3, the invention provides new anchor 2 with three attack angles x, y & z for penetration into a mooring bed (not shown). Similarly, FIG. 6 shows anchor 2A with two attack angles x' & y' and FIG. 8 shows anchor 2B with three attack angles x", y" & z".

Also as shown, the hitch member of the new anchors that is furthermost aft on the shank component should be positioned proximal of the prow end of the fluke of the anchor for the anchor to properly set into the mooring bed.

I claim:

1. A marine anchor comprising:

a fluke component in the form of a contoured, trapezoidal plate defined by a fluke prow end having a first width, a fluke aft end having a second width shorter than said first width, a pair of identical fluke starboard and fluke port halves, a fluke top surface and a fluke bottom surface, said plate having balanced starboard and port halves divided by a fluke longitudinal axis of symmetry, and a shank component of arcuate form having a shank longitudinal axis and comprising:

an elongated first leg portion defined by a first prow end, a first aft end, a first upper side, a first lower side, a first starboard side and a first port side, a second leg portion shorter than said first leg portion defined by a second top end and a second bottom end, said second top end being joined to said first aft end and said bottom end being joined to said fluke aft end so that said shank longitudinal axis is aligned with said fluke longitudinal axis of symmetry, and a plurality of hitch members fixed to and spaced apart along said elongated first leg enabling an anchor line to be attached to said anchor at different positions along said shank component to thereby provide a plurality of attack angles at which said anchor will tend to enter and proceed into the mooring bed during an anchoring operation employing said anchor.

2. The marine anchor of claim 1 wherein one of said plurality of hitch members is a transverse bore in said first prow end of said shank component.

3. The marine anchor of claim 2 that comprises a lug that extends upward from said first upper side of said first leg, said lug having a plurality of transverse bores therethrough that function as hitch members that receive shackles to join an anchor line to said anchor.

4. The marine anchor of claim 1 wherein said shank component is in the form of a longitudinally extending truss unit comprising a pair of flat longitudinal plate members and a multiplicity of cross stiffeners.

5. The marine anchor of claim 4 wherein said hitch members are rods spaced apart longitudinally along said truss unit welded between said plate members.

* * * * *